US006611101B1

(12) United States Patent
Mitobe et al.

(10) Patent No.: US 6,611,101 B1
(45) Date of Patent: Aug. 26, 2003

(54) ELECTRIC LIGHT BULB AND COATING METHOD OF ELECTRIC LIGHT BULB

(75) Inventors: Toshiaki Mitobe, Shizuoka (JP); Koichi Nakamura, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 177 days.

(21) Appl. No.: 09/596,960

(22) Filed: Jun. 20, 2000

(30) Foreign Application Priority Data

Jun. 22, 1999 (JP) ..... P. 11-175505

(51) Int. Cl.[7] ..... H01J 61/35
(52) U.S. Cl. ..... 313/635; 313/112; 313/580
(58) Field of Search ..... 313/112, 315, 313/316, 580, 110, 635, 116

(56) References Cited

U.S. PATENT DOCUMENTS

| | | | | |
|---|---|---|---|---|
| 4,379,249 A | * | 4/1983 | Walsh | 313/112 |
| 4,645,290 A | * | 2/1987 | Walsh | 350/1.7 |
| 4,844,607 A | * | 7/1989 | Andera et al. | 351/243 |
| 5,043,624 A | | 8/1991 | Hirozumi et al. | 313/318 |

* cited by examiner

*Primary Examiner*—Robert H. Kim
*Assistant Examiner*—Jurie Yun
(74) *Attorney, Agent, or Firm*—Fish & Richardson P.C.

(57) ABSTRACT

An electric light bulb that minimizes peeling of the coating, suppresses reduction of the number of light fluxes, and is easy to manufacture is described. The electric light bulb 1 has a glass bulb 2 having a straight tube 2*a* and a leading edge portion 2*b* that is continuous with the straight tube. A blue coating 5 is applied onto the straight tube, and a white or silver shield coating 6 is applied onto the leading end portion 2*b*.

1 Claim, 4 Drawing Sheets

ELECTRIC LIGHT BULB AND COATING METHOD OF ELECTRIC LIGHT BULB

BACKGROUND OF THE INVENTION

1. Field of the Invention

The present invention relates to a new electric light bulb and a new coating method for an electric light bulb. In particular, it relates to technology that lengthens the lifetime of an electric light bulb. The color temperature of radiated light of the light bulb is raised by the coating, the number of light fluxes are increased, and the electric light bulb is readily manufactured.

2. Description of the Related Art

Halogen lamp light sources have been used as automobile headlamps for a long time. More recently, a discharge lamp has been used as the light source of the headlamp.

However, halogen lamps are still in use, and users of the halogen lamp hope that the color temperature of the halogen lamp, which is about 2800 K, can be brought closer to the color temperature of the discharge lamp, which is about 4000 K.

One method of raising the color temperature is to increase the power supplied to the halogen lamp. However, this method reduces the lifetime of the electric light bulb. Therefore, in order to raise the color temperature, an attempt to remove a red component from the radiated light has been made by alternately laminating an evaporation film of titanium dioxide ($TiO_2$) and an evaporation film of silica ($SiO_2$) in eight to ten layers and then reflecting the red component at a boundary of each layer. However, according to this method, in an electric light bulb having a filament that is not positioned in the center of the bulb (for example, a high beam filament in a H4 bulb including a filament for high beam and a filament for low beam), a red component of light radiated from the filament and reflected at the layer boundary of the above evaporation films is projected at positions symmetrical with respect to the filament, so that a problem occurs because the red light is radiated onto the lower portion of the luminous intensity distribution of the high beam.

Therefore, four to eight layers of blue coating films have been formed on the glass bulb, so that the color temperature of the halogen lamp could be increased to about 3600 to 3700 K. Since the red component of the radiated light is absorbed in the blue coating films, the red light is prevented from leaking out on the lower portion of the luminous intensity distribution, in contrast to the electric light bulb of the previous example having the above described laminated evaporation films.

Generally, a light source bulb used in a headlamp for an automobile is subjected to a shield coating at the leading end thereof in order to prevent direct rays from being radiated. Conventionally, a shield coating was applied by using black paint. FIG. 7 illustrates a conventional electric light bulb "a" subjected to the above blue coating, and the black coating "c" was applied onto a blue shield coating "b". The conventional electric light bulb having a black coating c absorbs heat of the radiated light, so that the heat builds up within the leading end portion. Such a bulb has a problem because the blue coating tends to peel as the electric light bulb a is used repeatedly.

Further, since the black coating c also absorbs the radiated light, there is also a problem that the absolute number of the number of light fluxes is reduced, in cooperation with the light absorbed by the coating b.

SUMMARY OF THE INVENTION

The invention provides an electric light bulb which prevents peeling of the coating and suppresses reduction of the number of light fluxes. In addition, such an electric light bulb is easy to manufacture.

The electric light bulb of the invention includes a blue coating applied onto a straight portion of the tube, and a white or silver shield coating applied onto a leading end portion that is continuous with the straight tube. According to the electric light bulb of the invention, since the white or silver shield coating reflects heat and light without absorbing them, peeling of the coating caused by heat build-up within the leading end portion subjected to the shield coating does not occur, and the light reflected by the shield coating can be utilized effectively. Therefore, a reduction of the number of light fluxes can be suppressed.

A coating method of an electric light bulb according to the invention includes dipping the straight tube portion and the leading end portion that is continuous with the straight tube into color paint to apply the color paint onto them. Next, the leading end portion is dipped into a diluent of the color paint to remove the color paint applied onto the leading end portion. Lastly, the leading end portion is dipped into white or silver shield paint to apply the shield paint onto the leading end portion.

According to an implementation of the coating method of the electric light bulb of the invention, the straight tube portion of the electric bulb is subjected to only the blue coating and the leading end portion is subjected to only the shield coating. Such an electric light bulb can be readily manufactured.

Examples for carrying out an electric light bulb and a coating method of an electric light bulb according to the invention will be described below with reference to the drawings. In these examples, the invention is applied to coating of a H4 bulb.

BRIEF DESCRIPTION OF THE DRAWINGS

FIG. 4 shows a step of applying blue paint.

FIG. 5 shows a step of partially removing the blue paint.

FIG. 6 shows a step of applying silver paint.

DETAILED DESCRIPTION OF THE PREFERRED EMBODIMENTS

Figure 1:
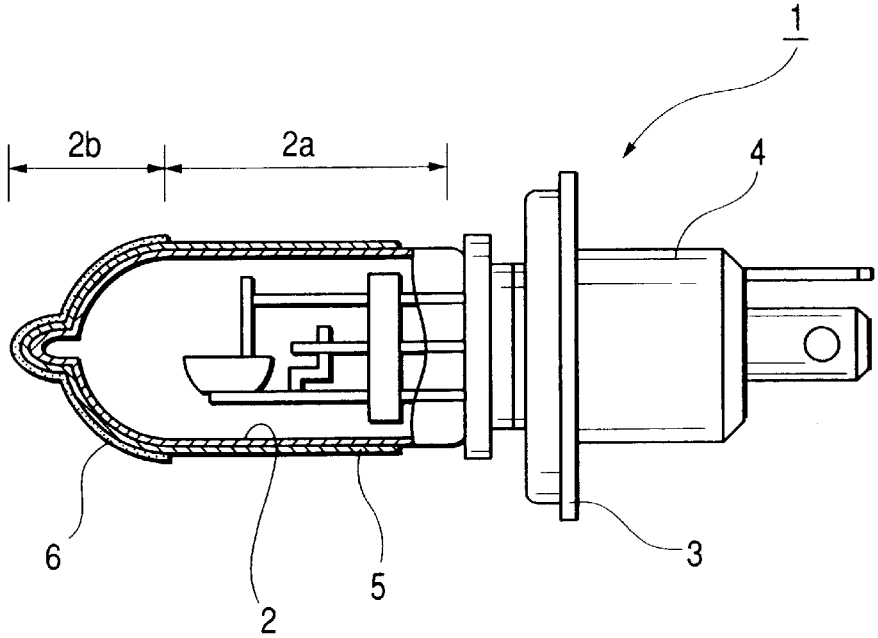
FIG. 1 is a side view including a partial cross-section of an electric light bulb according to the invention.

FIG. 1 illustrates a H4 bulb 1 that is formed by securing a base 4 having a flange 3 to a base portion of a glass bulb 2 made of hard glass. The glass bulb 2 comprises a substantially cylindrical straight tube 2*a* and a leading end portion 2*b* that is continuous with the straight tube 2*a*.

A blue coating 5 is applied to substantially the entire straight tube 2*a* of the glass bulb 2, except for a small portion near the base 4, and the leading end portion 2*b* also includes a white or silver shield coating 6. In fact, the blue coating 5 is applied onto substantially the entire glass bulb 2, except a small portion near the base, and the shield coating 6 is applied onto the blue coating 5 at the leading end portion 2*b*. Accordingly, in the H4 bulb 1, since the shield coating 6 is white or silver, heat from the radiated light is not absorbed in the shield coating and the heat does not build quickly within the leading end portion 2*b*. Therefore, peeling of the coating 5 or 6 is minimized. Further, the shield coating 6 reflects the radiated light back into the glass bulb 2, so that the reflected light can be effectively utilized. Therefore, the light fluxes absorbed by the blue coating 5 are recovered to suppress the reduction of the number of the light fluxes. With respect to satisfactory reflection, a silver coating is more effective than a white coating.

In the above H4 bulb 1, though the heat does not build quickly within the leading end portion 2*b*, since the blue coating 5 slightly absorbs heat, there is a problem that heat does build slightly within the leading end portion 2*b*. The H4 bulb 1A shown in FIG. 2 solves this problem.

Figure 2:
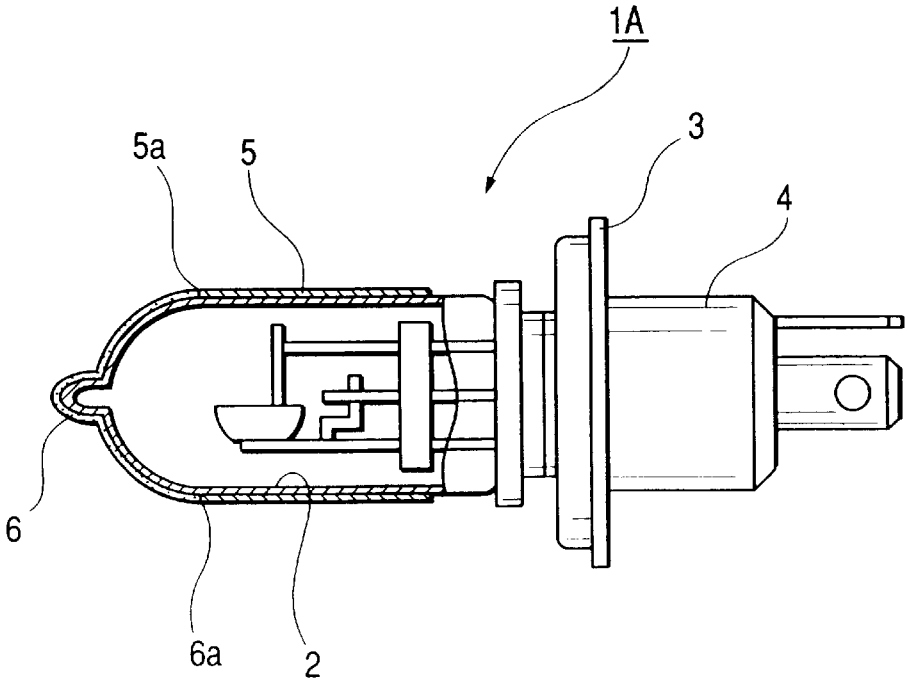
FIG. 2 is a side view and partial cross-section showing another mode for carrying out the electric light bulb of the invention.

In FIG. 2, the H4 bulb 1A includes a blue coating 5 applied onto only a straight tube portion 2*a*, and the white or silver shield coating 6 is applied onto only a leading end portion 2*b*. Accordingly, in the H4 bulb 1A, since the leading end portion 2*b* is subjected to only the shield coating 6, it is possible to minimize or completely prevent heat from building up within the leading end portion 2*b*.

In the H4 bulb 1A, the blue coating 5 and the shield coating 6 are connected to each other only at their end portions. Therefore, there is a concern that the end portion of the blue coating 5 that slightly absorbs heat may peel back. An H4 bulb 1B shown in FIG. 3 solves this problem.

Figure 3:
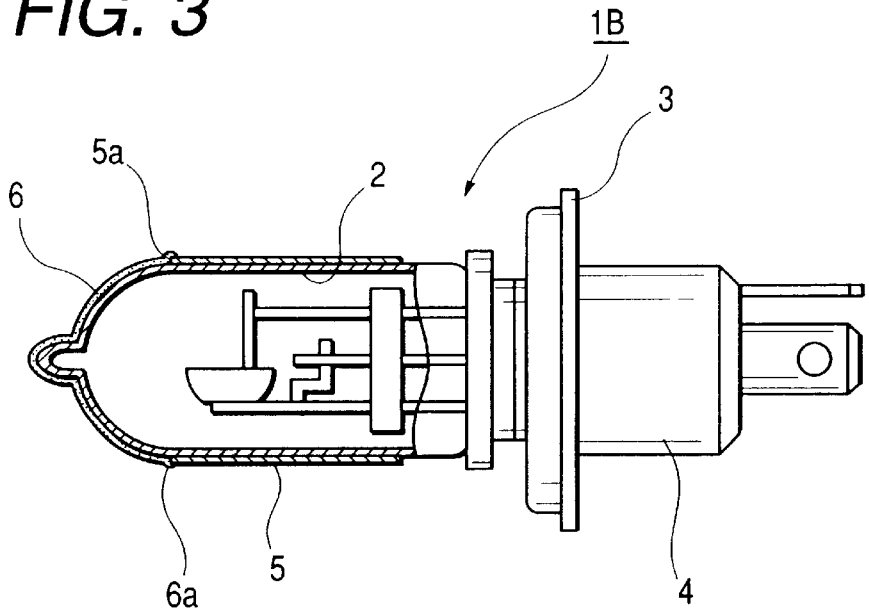
FIG. 3 is a side view and partial cross-section showing another mode for carrying out the electric light bulb of the invention.

FIG. 3 illustrates an H4 bulb 1B having a straight tube 2*a* including only the blue coating 5 and a leading end portion 2*b* including only the while or silver shield coating 6. An end portion 6*a* of the shield coating 6 slightly overlaps an end portion 5*a* of the blue coating 5. Accordingly, in the H4 bulb 1B, since the end portion 5*a* of the blue coating 5 is overlaid by the end portion 6*a* of the shield coating 6, peeling of the end portion 5*a* of the blue coating 5 is prevented.

A coating method of an electric light bulb will now be described with reference to FIGS. 4 to 6.

Figure 4:
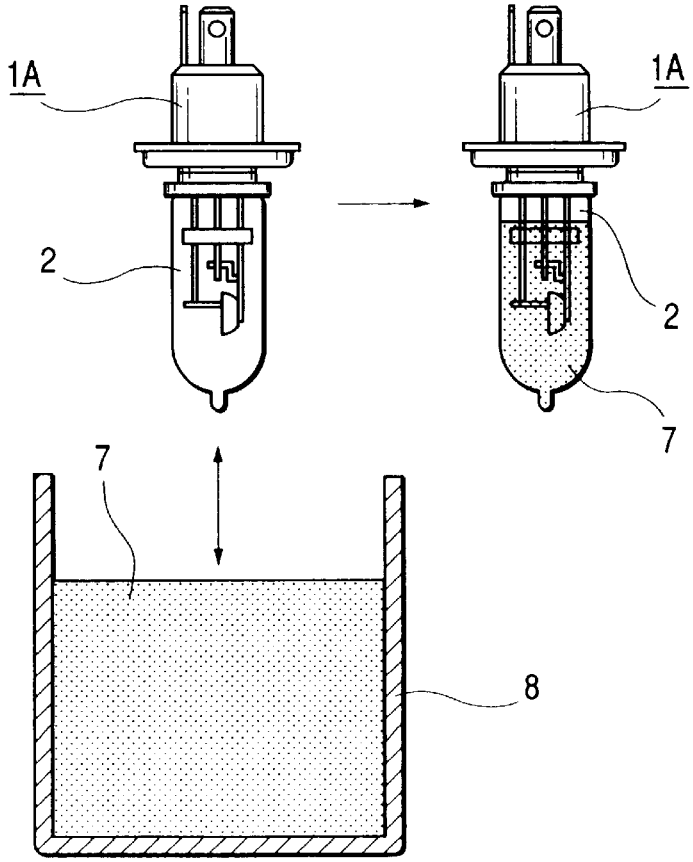
FIGS. 4 to 6 illustrate a coating method of an electric light bulb.

Referring to FIG. 4, a blue dipping tank 8 in which blue paint is stored is prepared. The H4 bulb 1A is moved down in relation to the blue dipping tank 8 and the glass bulb 2 is dipped into the blue paint 7. Thereafter, the H4 bulb 1A is drawn up in relation to the blue dipping tank 8, whereby the straight tube 2*a* and the leading end portion 2*b* of the glass bulb 2 are coated with the blue paint as shown.

Figure 5:
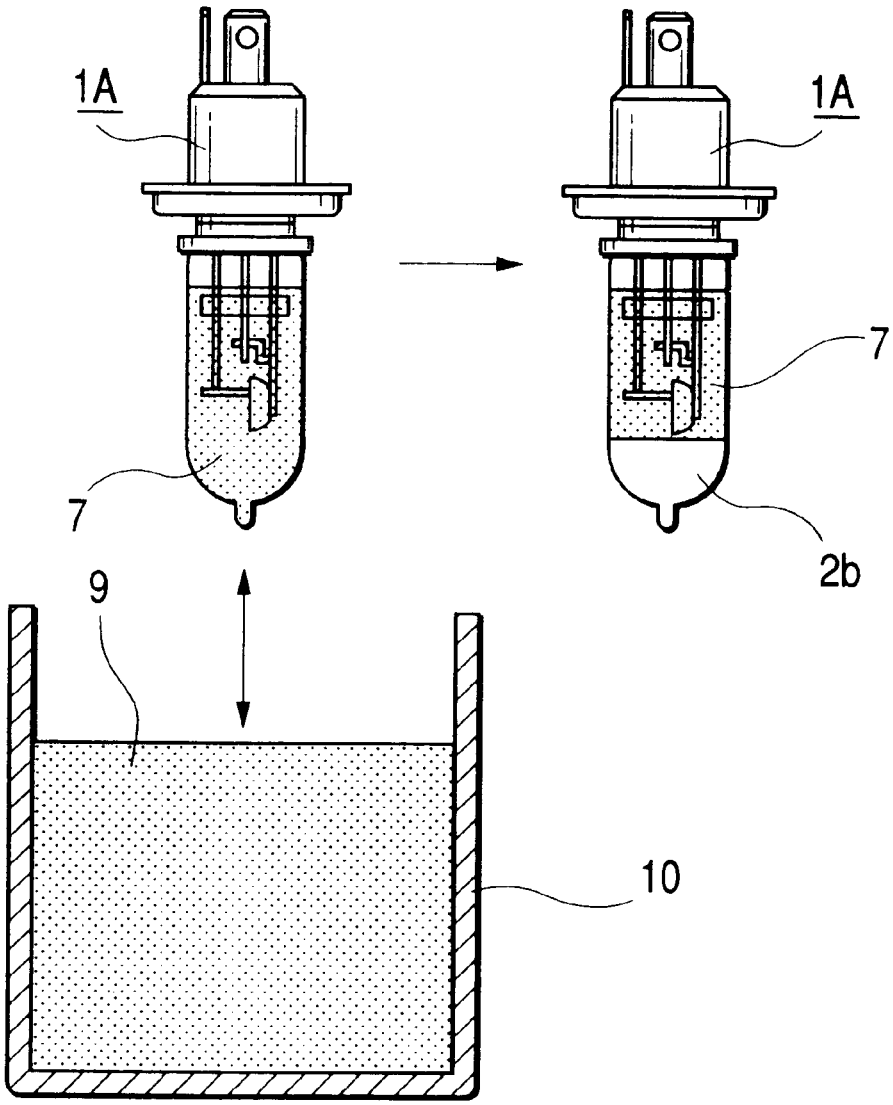

Next, referring to FIG. 5, only the leading end portion 2*b* is dipped into a blue paint diluent 9 in a blue dilution tank 10. The blue paint diluent 9 removes the blue paint on the leading end portion 2*b* of the glass bulb 2 as shown. Then, as illustrated in FIG. 6, the leading end portion 2*b* of the glass bulb 2 is dipped into a silver paint 11 in a silver dipping tank 12. The leading end portion 2*b* of the glass bulb 2 is thus coated with the silver paint 11. The paints 7 and 11 applied on the glass bulb 2 may then be heated to complete the coating process for the glass bulb 2.

Figure 6:
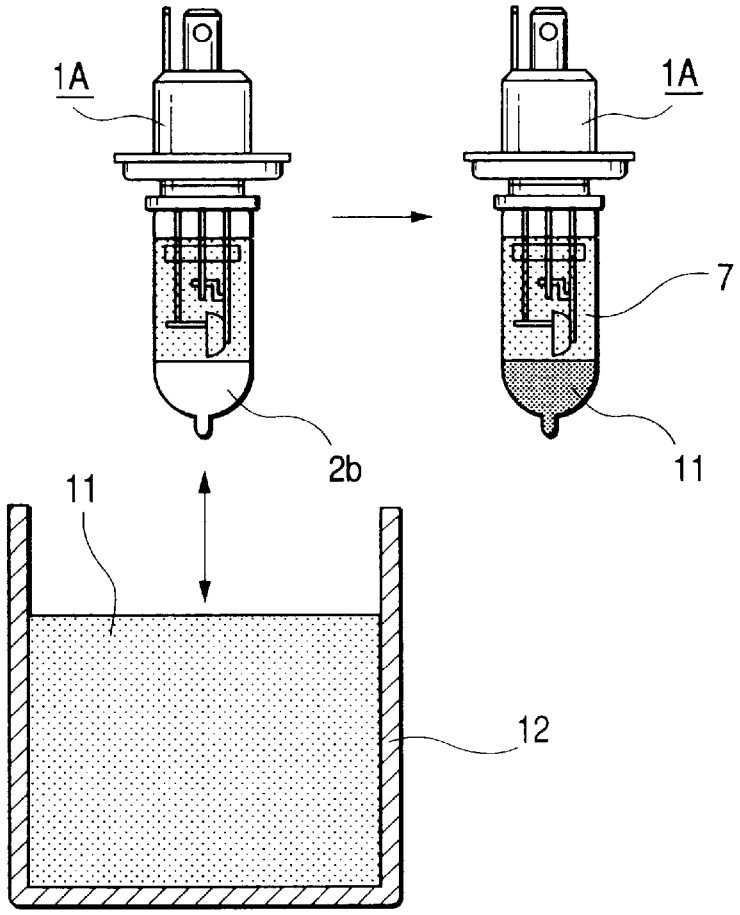
Figure 7:
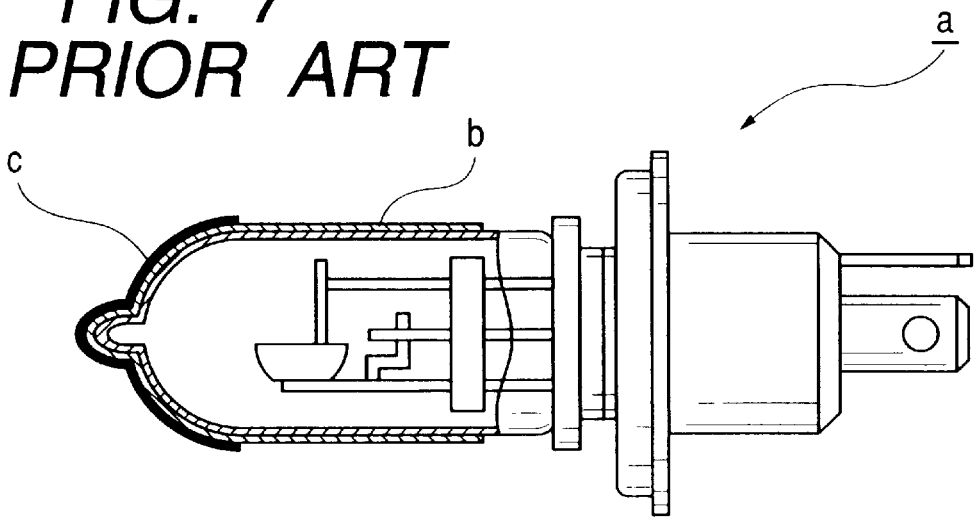
FIG. 7 PRIOR ART
FIG. 7 is a side view and partial cross-section of a conventional electric light bulb.

The steps shown in FIGS. 5 and 6, in which the H4 bulb 1A is moved down in relation to each of the tanks 10 and 12 and then relatively drawn up, are similar to the step shown in FIG. 4.

By utilizing the above steps shown in FIGS. 4 to 6, the H4 bulb 1A can be readily formed to include the blue coating 5 applied onto only the straight tube 2*a* of the glass bulb, and the silver coating 6 applied onto only the leading end portion 2*b*. Further, in the step shown in FIG. 6, in the case described earlier of coating silver paint to overlap a leading end portion of the blue paint 7 remaining on the glass bulb 2, the above H4 bulb 1B can be readily manufactured.

In the above example for carrying out the invention, the various dipping steps are applied to an H4 bulb. However, the scope of the invention is not limited to the H4 bulb, and the invention can be widely applied to electric light bulbs other than the H4 bulb.

Furthermore, the shape and structure of each part shown in the above examples for carrying out the invention are only one example. Therefore, it should be noted that the technical scope of the invention should not be limited.

As clear from the above description, an electric light bulb suitable for application of the invention is a glass electric light bulb having a substantially cylindrical straight tube, wherein a blue coating is applied onto the straight tube, and a white or silver shield coating is applied onto a leading end portion that is continuous with the straight tube.

Therefore, according to the electric light bulb of the invention, since the white or silver shield coating reflects heat and light without absorbing them, peeling of the coating caused by heat that builds within the leading end portion of conventional light bulbs having the shield coating does not occur, and the light reflected by the shield coating can be utilized effectively. Therefore, a reduction of the number of light fluxes can be suppressed.

According to another aspect of the invention, the straight tube includes only the blue coating, and the leading end portion includes only the shield coating. Therefore, heat is reliably prevented from building in the leading end portion.

According to yet another aspect of the invention, the shield coating overlaps the blue coating at a boundary portion between the blue coating and the shield coating. Therefore, it is possible to minimize or substantially prevent peeling of the end portion of the blue coating.

A coating method of an electric light bulb according to the invention includes applying a color coating onto a substantially cylindrical straight tube portion of an electric light bulb, and applying a silver shield coating onto a leading end portion of the light bulb. This method may include comprises the steps of dipping the straight tube, and the leading end portion that is continuous with the straight tube, into color paint to apply the color paint onto them; dipping only the leading end portion into a diluent of the color paint to remove the color paint applied onto the leading end portion; and then dipping the leading end portion into white or silver shield paint to apply the shield paint onto the leading end portion. Therefore, according to the coating method of the invention, an electric light bulb, in which the straight tube is subjected to only the color coating and the leading end portion is subjected to only the shield coating, can be readily manufactured.

According to another aspect of the invention, the leading end portion is dipped into the shield paint in such a manner that the shield paint overlaps a side end portion of a leading end of the color paint. Therefore, an electric bulb, in which the straight tube contains only the color coating and the leading end portion contains only the shield coating, and in which the end portion of the shield coating overlaps on the end portion of the color coating, can be readily manufactured.

The present invention is based on Japanese Patent Application No. Hei. 11-175505 which is incorporated herein by reference.

What is claimed is:

1. An electric light bulb having a substantially cylindrical straight tube portion continuous with a leading end portion comprising:

a blue coating applied onto the straight tube; and a white or silver shield coating applied onto the leading end position;

wherein the straight tube contains only the blue coating, the leading end portion contains only the shield coating and, wherein the shield coating overlaps the blue coating at a boundary portion between the blue coating and the shield coating.

* * * * *